US008728698B2

(12) United States Patent
Nagayama et al.

(10) Patent No.: US 8,728,698 B2
(45) Date of Patent: May 20, 2014

(54) CARRIER, DEVELOPER, IMAGE FORMING METHOD AND PROCESS CARTRIDGE

(75) Inventors: Masashi Nagayama, Mishima (JP); Kimitoshi Yamaguchi, Numazu (JP); Naoki Imahashi, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 690 days.

(21) Appl. No.: 12/282,077

(22) PCT Filed: Mar. 6, 2007

(86) PCT No.: PCT/JP2007/054752

§ 371 (c)(1),
(2), (4) Date: Sep. 8, 2008

(87) PCT Pub. No.: WO2007/102614

PCT Pub. Date: Sep. 13, 2007

(65) Prior Publication Data

US 2009/0092920 A1 Apr. 9, 2009

(30) Foreign Application Priority Data

Mar. 7, 2006 (JP) ..... 2006-061716

(51) Int. Cl.

| | |
|---|---|
| ***G03G 9/113*** | (2006.01) |
| ***G03G 13/20*** | (2006.01) |
| ***G03G 9/08*** | (2006.01) |
| *G03G 15/20* | (2006.01) |

(52) U.S. Cl.

CPC ..... *G03G 9/1137* (2013.01); *G03G 9/0819* (2013.01); *G03G 9/0821* (2013.01); *G03G 9/0823* (2013.01); *G03G 15/20* (2013.01)

USPC ..... 430/111.4; 430/111.32; 430/111.35; 430/124.1; 430/125.3

(58) Field of Classification Search

CPC . G03G 9/0819; G03G 9/0821; G03G 9/0835; G03G 9/0836; G03G 9/0838; G03G 9/1075; G03G 9/1137

USPC ..... 430/111.31, 111.32, 111.33, 118.7, 430/118.8, 125.3, 111.4, 111.35, 124.1

See application file for complete search history.

(56) References Cited

U.S. PATENT DOCUMENTS

| | | | | |
|---|---|---|---|---|
| 4,663,262 | A | 5/1987 | Oka et al. | |
| 6,372,400 | B1 * | 4/2002 | Yoshizaki et al. | 430/111.32 |

(Continued)

FOREIGN PATENT DOCUMENTS

| | | |
|---|---|---|
| JP | 58 23032 | 2/1983 |
| JP | 58 144839 | 8/1983 |

(Continued)

OTHER PUBLICATIONS

U.S. Appl. No. 12/209,607, filed Sep. 12, 2008, Nagayama, et al.

(Continued)

*Primary Examiner* — Jonathan Jelsma

(74) *Attorney, Agent, or Firm* — Oblon, Spivak, McClelland, Maier, & Neustadt, L.L.P.

(57) ABSTRACT

The present invention is to provide a carrier and a developer, which have fewer occurrences of carrier adhesion and background smear, excellent granularity and longer durability. The carrier comprises the core material particles having magnetism and resin coating layer covering the core material particles, and wherein the weight average particle diameters is in the range of 22 m to 32 m, the proportion of the weight average particle diameters relative to the number average particle diameter is in the range of 1.00 to 1.20, the content of particles having a diameter of 20 m or smaller is 7% by mass, the content of carrier particles having a diameter of 36 m or smaller is in the range of 90% by mass to 100% by mass, and the proportion of the particle density of the core material particles is in the range of 85% to 100% of the true density of the core material particles.

26 Claims, 3 Drawing Sheets

(56) References Cited

U.S. PATENT DOCUMENTS

| | | | | |
|---|---|---|---|---|
| 6,472,118 | B1 | 10/2002 | Yamaguchi et al. | |
| 6,500,595 | B1 | 12/2002 | Mochizuki et al. | |
| 2003/0044709 | A1 | 3/2003 | Yamaguchi et al. | |
| 2003/0068178 | A1 * | 4/2003 | Igarashi | 399/267 |
| 2003/0211415 | A1 | 11/2003 | Yamaguchi et al. | |
| 2005/0064315 | A1 | 3/2005 | Yamaguchi et al. | |
| 2006/0099009 | A1 * | 5/2006 | Miyamoto et al. | 399/119 |
| 2007/0048652 | A1 | 3/2007 | Imahashi et al. | |
| 2008/0096121 | A1 | 4/2008 | Iwatsuki et al. | |

FOREIGN PATENT DOCUMENTS

| | | |
|---|---|---|
| JP | 61 151551 | 7/1986 |
| JP | 6 222619 | 8/1994 |
| JP | 3029180 | 2/2000 |
| JP | 2001-117287 | 4/2001 |
| JP | 2001-209215 | 8/2001 |
| JP | 2004-77568 | 3/2004 |
| JP | 2005-250424 | 9/2005 |
| JP | 2005 266214 | 9/2005 |
| JP | 2006 39445 | 2/2006 |

OTHER PUBLICATIONS

Chinese Office Action issued Jan. 31, 2011, in Patent Application No. 200780015658.8.

Extended European Search Report issued May 26, 2011, in Patent Application No. 07715310.4.

Japanese Information Offer Form issued Jan. 14, 2009, in Patent Application No. 2006-61716 (with English-language translation).

Japanese Information Offer Form issued Nov. 29, 2010, in Patent Application No. 2006-61716 (with English-language translation).

* cited by examiner

CARRIER, DEVELOPER, IMAGE FORMING METHOD AND PROCESS CARTRIDGE

TECHNICAL FIELD

The present invention relates to a carrier, a developer, an image forming method and a process cartridge.

BACKGROUND ART

Developing processes of electrophotography are divided into a so-called one-component developing process using primarily a toner, and a so-called two-component developing process using a mixture of a toner with a glass bead, a magnetic carrier, or a coat carrier made of the glass bead or the magnetic carrier wherein their surface is coated with resin or the like.

In such a two-component developing process, a carrier is used, and thus a two-component developer has a wider area frictionally charged to toner. In addition, the two-component developing process is more stable in charge property than the one-component developing process and is advantageous in providing high-quality images over a long period of time and has a high-ability of supplying a toner to areas to be developed. Thus, the two-component developing process is frequently used particularly in high-speed machine.

In an electrophotographic system employing a so-called digital method wherein a latent electrostatic image is formed on an image bearing member using a laser beam or the like and the latent electrostatic image is visualized, the two-component developing method utilizing the above-noted features is also widely employed.

In recent years, demands of higher stabilization and better quality of electrophotographic images have been increased. Especially, a developments of image developing system capable of high-fidelity latent image development has become extremely important in minimizing the minimal unit (one dot) of latent images and increasing the density in order to enhancements the quality of images. Furthermore, reduction in the dispersion of electrification distribution has became important on stabilization of image quality.

There have been various proposals on the use of a small diameter carrier, as minimizing the particle diameter of carrier is considered as an effective way for high-fidelity latent image development.

For example, Patent Literature 1 proposes a magnetic carrier made of ferrite particles with spinel structures and an average particle diameter of less than 30 μm, however, the proposed carrier is not coated with resin and is used under low-electric field applied thereon, and has disadvantages in that it has poor developing ability and, because its is not coated with resin, it has a short operating life.

Furthermore, Patent Literature 2 proposes an electrophotographic carrier having carrier particles having the 50% average particle diameter ($D_{50}$) in the range of 15 μm to 45 μm, the carrier contains carrier particles having a particle diameter less than 22 μm in the range of 1% to 20%, less than 16 μm in the range of 3% or less, 62 μm or more in the range of 2% to 15%, 88 μm or more in the range of 2% or less, and the specific surface area $S_1$ of the carrier determined by air permeability method and the specific surface area $S_2$ of the carrier calculated by the equation $S_2=(6/\rho\cdot D_{50})\times 10^4$ (ρ represents a specific gravity of carrier) satisfy the condition $1.2\leq S_1/S_2\leq 2.0$.

When the above-noted carrier with small particle diameters is used, there are the following advantages:

(1) Sufficient frictional charges can be given to individual toner particles because the carrier has a large surface area per unit volume, and the carrier has fewer occurrences of being low-charged and/or oppositely-charged. As a result, fewer background smears occur, and because of less quantity of toner dusts in the areas around dots and image blurs, the carrier can provide excellent dot reproductivity;

(2) The average charge amount of toner can be lowered because the carrier has a large surface area per unit volume and less occurrence of background smear, providing sufficient image densities; and (3) A dense magnetic brush can be formed because of the carrier having a small particle diameter. And the excellent flowability of the magnetic brush will reduce the occurrence of magnetic brush trails left on an image surface.

However, the related proposed carrier having small particle diameters has disadvantages in that carrier adhesion easily occurs, causing occurrences of image bearing member flaws and fixing roller flaws, thus implementation of the related proposed carriers is difficult.

In particular, when a carrier having an average particle diameter of less than 32 μm is used, the carrier surface texture will be drastically improved, and a high image quality can be obtained, however, there is a problem wherein carrier adhesion occurs very easily.

(Patent Literature 1;) Japanese Patent Application Laid-Open No. 58-144839

(Patent Literature 2;) Japanese Patent No. 3029180

DISCLOSURE OF INVENTION

An object of the present invention is to solve the foregoing conditional problems and to provide a carrier and a developer which has fewer occurrences of carrier adhesion, excellent granularity, fewer occurrences of background smears, and higher durability, as well as to provide an image forming method using the developer and a process cartridge using the developer.

The inventors of the present invention conducted a careful examination regarding the above-mentioned problems, and the examination resulted as follows:

A carrier adhesion occurring at image portions and/or background portions occurs in a form of carrier or form of cut off magnetic brush when the following condition is met:

Fm<Fc (Fm represents a magnetic binding force, and Fc represents a force causing carrier adhesion.)

The force causing carrier adhesion, or Fc, is associated with a developing potential, a background potential, a centrifugal force applied to carrier, a carrier resistance, and a charge amount of the developer. Thus, adjusting each parameter is an effective way to reduce the Fc so that occurrences of carrier adhesion can be prevented, however, the current situation is that drastically changing the force (Fc) is difficult because Fc has close relations with developing ability, background smear and toner scattering.

The magnetic binding force (Fm) is represented by the following equation:

$$Fm=K\times M\times(\partial H/\partial x)$$

Where K is mass of carrier and represented by $$K=(4/3)\pi\cdot r^3\cdot\rho\times M$$

(Where "r" represents the radius of carrier, and ρ represents the true density of carrier)

and M represent magnetization of carrier per unit mass.

And H (tilt of the magnetic field intensity in a position in which a carrier exists) is represented by the following formula:

$$(\partial H/\partial x)$$

As magnetic binding force (Fm) applied to the carrier is proportional to cubic root of radius (r) of the carrier, minimizing the particle diameter of the carrier will drastically reduce the magnetic binding force proportionally to the cubic root of the particle diameter, causing higher occurrence of carrier adhesion.

The inventors of the present invention conducted a careful examination to solve the above-mentioned problem, and thus, the present invention is based on the conducted examination.

The above-mentioned problem can be solved with the following (1)-(15) of the present invention.

(1) A carrier including:

a core material particle having magnetism; and a resin coating layer which covers the surfaces of the core material particle, wherein the weight average particle diameter of the carrier is in the range of 22 μm to 32 μm, the proportion of the weight average particle diameter of the carrier relative to the number average particle diameter of the carrier is in the range of 1.00 to 1.20, the content of the particles having particle diameters of 20 μm or smaller is 7% by mass or less, and the content of the particles having particle diameters of 36 μm or smaller is in the range of 90% by mass to 100% by mass, and the particle density of the core material particles relative to the true density of the core material particles is in the range of 85% to 100%.

(2) The carrier according to (1), wherein the density of the core material particles is in the range of 4.5 g/cm$^3$ to 5.2 g/cm$^3$.

(3) The carrier according to one of (1) and (2), wherein the magnetization is in the range of 50 emu/g to 100 emu/g when a 1,000 Oersted magnetic field is applied thereto.

(4) The carrier according to any one of (1) to (3), wherein the core material particles is a Mn—Mg—Sr ferrite, a Mn ferrite, or a magnetite.

(5) The carrier according any one of (1) to (4), wherein the volume resistivity when 500V/mm of electric field is applied thereto is in the range of 1×1011 Ω·cm to 1×1016 Ω·cm.

(6) The carrier according to any one of (1) to (5), wherein the resin coating layer includes hard particles.

(7) The carrier according to (6), wherein the hard particles includes of at least one selected from the following particles:

silicon oxide particles, or titanium oxide particles, or metallic aluminum oxide particles.

(8) The carrier according to one of (6) and (7), wherein the content of the hard particles of the resin coating layer is 5% by mass to more or 70% by mass or less.

(9) The carrier according to any one of (1) to (8), wherein the resin coating layer includes an aminosilane coupling agent.

(10) The carrier according to any one of (1) to (9), wherein the resin coating layer has a cross-liking product of thermoplastic resin and a guanamine resin and/or a cross-liking product of thermoplastic resin and melamine resin.

(11) The carrier according to (10), wherein the thermoplastic resin is an acrylate resin.

(12) A developer including:

the carrier according to any one of (1) to (11); and the toner.

(13) An image forming method, wherein an image is formed with the developer according to (12).

(14) The image forming method according to (13), wherein the developer on a developer bearing member is used in a developing process for developing a latent electrostatic image formed on an image bearing member, and wherein alternate current and/or direct current is applied as a developing bias for the developing process.

(15) A process cartridge including:

an image developing unit using the developer according to (12) and the image bearing member, wherein the process cartridge integrally supports at least the developing unit and the image bearing member and wherein the process cartridge is detachably attached to an image forming apparatus.

According to the present invention, it is possible to provide a carrier and a developer, which have less occurrence of carrier adhesion and background smear, excellent granularity and longer durability, and the present invention can provide an image forming method, which uses the developer, and a process cartridge.

BEST MODE FOR CARRYING OUT THE INVENTION

Figure 1:
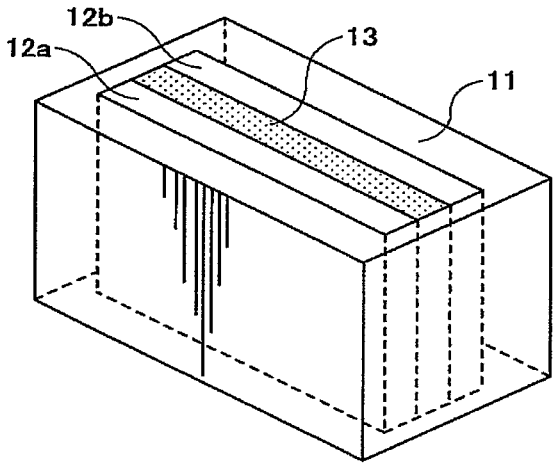
FIG. 1 shows a cell used for measuring the volume resistivity of a carrier.

The best mode of the implementation of the present invention will be explained with reference to the drawings.

The carrier of the present invention includes core material particles having magnetism and a resin coating layer covering the core material particles, wherein the weight average particle diameters of the carrier particles is in the range of 22 μm to 32 μm, the proportion of the weight average particle diameters of the carrier particles relative to the number average particle diameter is in the range of 1.00 to 1.20, the content of particles having a diameter of 20 μm or smaller is 7% by mass or less, the content of carrier particles having a diameter of 36 μm or smaller is in the range of 90% by mass to 100% by mass, and the proportion of the particle density of the core material particles relative to the true density of the core material particles is in the range of 85% to 100%. Thus, the carrier of the present invention can reduce the occurrence of background smear caused by making particle diameter smaller, improve the image quality through improvement of dot reproductivity, and effectively reduce the occurrence of carrier adhesion.

The weight average particle diameter (Dw) of the carrier of the present invention is in the range of 22 μm to 32 μm, and more preferably 23 μm to 30 μm. The occurrence of carrier adhesion will be reduced when the weight average particle diameter (Dw) is 32 μm or larger, however, the toner cannot truthfully develop a latent image, and the dot diameter variation will be increased, degrading the granularity. In addition, higher toner density will cause higher occurrence of background smears.

Carrier adhesion represents a phenomenon wherein carrier particles adhere to image portions and/or background portions of a latent electrostatic image. Stronger electric field can increase the occurrence of carrier adhesion. Image portions tend to have less occurrence of carrier adhesion compared with background portion because of the decrease in the electric field caused by toner development.

Occurrences of carrier adhesion are unfavorable because they may lead to troubles, such as flaws on image bearing members and/or on fixing rollers, etc. When the proportion between the number average particle diameter (Dp) and the weight average particle diameter (Dw), or Dw/Dp, is 1.20 or more, the proportion of the fine particles will be increased, and the resistance to carrier adhesion may be degraded.

In the present invention, the content of the carrier particles having a diameter smaller than 20 μm is 7% by mass or less, preferably 5% by mass or less, and more preferably 3% by mass or less. When the content of the carrier particles having a diameter in 20 μm or larger exceeds 7% by mass, the particle diameter distribution will be widen, and particles having a small magnetization may reside on the entire magnetic brush, drastically increasing the occurrences of carrier adhesion.

In addition, a desirable content of the carrier particles with the diameter of less than 20 μm is 0.5% by mass or more. This desirable condition can provide conditions with high cost-effectiveness.

And the content of the carrier particles having a diameter of 36 μm or smaller is 90% by mass or more, and preferably 92% by mass or more. The carrier which is coated with resin and has a narrow particle diameter distribution has less variation of the magnetization of each carrier, and can improve the resistance to carrier adhesion.

In the present invention, the weight average particle diameter (Dw), regarding the carrier, the core material particles of the carrier and the toner, is calculated based on the particle diameter distribution of particles (the relation between the number based frequency and the particle diameter) measured on a number basis. The weight average particle diameter (Dw) is represented by the following equation, (1).

$$Dw=\{1/\Sigma(nD^3)\}\times\{\Sigma(nD^4)\} \quad (1)$$

In the equation (1), D represents a representative particle diameter (μm) of particles residing in each channel, and "n" represents the number of particles residing in each channel. It should be noted that each channel is a length for equally dividing the scope of particle diameters in the particle size distribution chart, and 2 μm is employed for each channel in the present invention. For the typical particle diameter of particles residing in each channel, the lower limit value of particle diameters of the respective channels is employed.

Furthermore, the number average particle diameter (Dp) regarding the carrier and the core material particles of the carrier is calculated based on the particle diameter distribution of particles measured on a number basis. The number average particle diameter (Dp) is represented by the following equation, (2).

$$Dp=\{1/\Sigma(n)\}\times\{\Sigma(nD)\}$$

In the equation (2), N represents the total number of particles measured, "n" represents the number of particles residing in each channel, and D represents the lower limit value of particle diameter in each channel (2 μm).

The particle size analyzer (Model HRA9320-X100, manufactured by Honewell Corp.) can be used as a particle size analyzer for measuring the particle size distribution in the present invention.

Measurement conditions are as follows:

[1] Range of particle diameters: 8 μm to 100 μm

[2] Channel length (channel width): 2 μm

[3] Number of channels: 46

[4] Refractive index: 2.42

The particle density of the core material particles of the carrier of the present invention is 85% or more of the true density of the core material particles. The particle density means the calculated volume of particle density which includes the internal closed cavities of a particle and excludes dents and cracks existing on the surface of the particle and opened spaces. By contrast, the true density means the calculated volume of the true density which excludes internal closed cavities of a particle from the particle density. Further details will be explained later, but it should be noted that the true density should preferably be equal to the particle density of the core material particles for maximizing the magnetic performance of the core material. In practice, however, air will be taken into the core material particles during a manufacturing process, thus, the particle density of the core material particles is smaller than the true density of the core material particles. More specifically, smaller proportion of particle density relative to the true density of the core material particles means that more air gaps are existing in the inside space of the core material particles.

More air gaps existing in the inside space of particles can further reduce the magnetic binding force (Fm) applied to particles, as the magnetic binding force (Fm) is proportional to the mass of the particles. Hence, air gaps existing in the inside of particles degrade the magnetic performance of substances making particles.

As changing the magnetization parameter of core material particles of the core often results in affecting other parameters, such as electrical resistance, reducing as many air gaps existing in the inside core material particles as possible is desirable for enhancing the magnetic binding force (Fm) by increasing the magnetization on a particle basis with less affecting on other parameters.

Furthermore, variations in the total amount of air gaps among particle will directly lead to the variations in their mass of particles, causing generation of particles having extremely weak magnetic binding force (Fm). The best practical way for preventing such generation of particles having extremely weak magnetic binding force (Fm) caused by the variation of total amount of air gaps is to reduce the width of the variation therethrough reducing the air gaps, as controlling the variation of the amount of air taken into particles during manufacturing process is particularly difficult.

The particle density of the core material particles of the carrier is preferably 4.5 g/cm$^3$ to 5.2 g/cm$^3$, more preferably 4.7 g/cm$^3$ to 5.0 g/cm$^3$. When the particle density is more than 5.2 g/cm$^3$, the coating layer of carrier may be easily exfoliated because of occurrences of carrier spent from the toner and the frictional force of inter-carrier particles, and this may easily lead to degradations in the temporal charge ability. When the particle density is less than 4.5 g/cm$^3$, magnetic binding force (Fm) will be reduced, as mass per particle of the carrier will be reduced, causing more frequent occurrences of carrier adhesions.

The particle density of the core material particles can be measured with a dry automatic densitometer (ACUPIC 1330, manufactured by Shimadzu Corporation). And the true density of core material particles can be determined by measuring the particles after eliminating air gaps by smashing them. Existing methods can be employed for smashing the particles, and for example, a mortar, a millstone, or a ball mill can be used. Whatever methods will be used, the most important thing is to smash particles until all air gaps are eliminated. An X-ray microscope (TUX-3000W, manufactured by Token Corporation) can be used to check if all air gaps are eliminated.

The magnetization of the carrier of the present invention is preferably 50 emu/g or more, more preferably 70 emu/g or more, when a magnetic field of 1,000 Oersted (Oe) is applied thereto. This can reduce the occurrence of carrier adhesion. From the point of view for reducing carrier adhesion, the upper value of the magnetization is not limited, and normally 150 emu/g is the upper limitation, however, too strong magnetization can reduce the fluidity of the magnetic brush, so the value should be kept at 100 emu/g or under in view of higher quality of images.

The occurrence of carrier adhesion can cause flaws on the image bearing member and/or of the fixing roller, with degrading the quality of images. The magnetization of the carrier, when a 1,000 Oersted (Oe) magnetic field is applied thereto, should not be smaller than 50 emu/g from a practical standpoint, as enough magnetic binding force (Fm) cannot be achieved, that can be resulting in causing higher occurrence of carrier adhesion, even if air gaps of core material particles are eliminated.

The magnetization of the carrier can be measured in the following ways.

Carriers weighing 1.0 g are put into a cylindrical cell with a B-H tracer (BHU-60, manufactured by Riken Electronics Co., Ltd.) and then the cylinder is set on the apparatus.

The magnetic field is slowly increased until it reaches 3,000 Oersted.

After the magnetic field is slowly decreased until it reaches 0 Oersted, the magnetic field is slowly increased in the reverse direction until it reaches 3,000 Oersted.

After the magnetic field is slowly decreased until it reaches 0 Oersted, the magnetic filed is increased in the first direction.

A B-H curve can be illustrated with this means, and the magnetization of a 1,000 Oersted can be given with the curve.

Examples of core materials used for particles, which can have 50 emu/g or more magnetization when a 1,000 Oersted magnetic field is applied thereon, are ferromagnetic materials such as irons and cobalts, magnetites, hematites, Li ferrites, Mn—Zn ferrites, Cu—Zn ferrites, Ni—Zn ferrites, Ba ferrites and Mn ferrites.

Ferrite is a sinter body which is usually represented by the following general formula.

$$(MO)_x(NO)_y(Fe_2O_3).$$

Where x, y, and z represent a composition proportion, and M and N independently represent Ni, Cu, Zn, $Li_2$, Mg, Mn, Sr, Ca or other elements and are respectively constituted by a complete mixture of a ferrioxide and an iron oxide (III).

For materials of core material particles used in the carrier of the present invention, known magnetic materials can be used, however, magnetite, hematite, Mn—Mg—Sr ferrite and Mn ferrite are examples of core materials, used more preferably for particles, which can have 70 emu/g or more magnetization when a 1,000 Oersted magnetic field is applied.

The volume resistivity of the carrier of the present invention when an electric field of 500V/mm is applied thereon is preferably $1\times10^{11}$ to $1\times10^{16}\Omega\cdot$cm, and more preferably $1\times10^{12}$ to $1\times10^{14}\Omega\cdot$cm. Thus, when it is used with an appropriate amount of charge applied to the toner, enough image densities can be obtained.

If the volume resistivity of the carrier is smaller than $1\times10^{11}$ [$\Omega\cdot$cm], charges will easily be induced to the carrier, increasing the occurrence of carrier adhesions when the developing gap (the closest distance between the image bearing member and the developing sleeve) is narrowed. Normally, a low resistance carrier is used for developing color toner in order to achieve sufficient amount of toner adhesion. Moreover, if the volume resistivity of the carrier is, greater than $1\times10^{16}\Omega\cdot$cm, charges of the reverse polarity of the toner will be easily accumulated, charging the carrier and increasing occurrences of carrier adhesions.

The volume resistance of the carrier can be measured by the following methods. As shown in FIG. 1, an electrodes (12*a*, 12*b*) having a 2 mm interelectrode distance and 2×4 cm surface areas are contained in a cell 11 composed of a fluorine-resin-made container which is filled with a carrier 13. Then, direct current of 100V is applied between the electrodes, and direct current resistance is measured with a high-resistance-meter 4329A (4329A and LJK 5HVLV WDQFH OHWHU, manufactured by YOKOGAWA Hewlett-Packard Corporation). To measure the volume resistance of the carrier, the cell brimmed with the carrier is tapped for 20 times, and then the upper surface of the cell is made flat with a flat nonmagnetic spatula along with the top of the cell at action. Applying pressure is not necessary on filling up the cell with the carrier.

The volume resistance of the carrier can be adjusted by adjusting the resistance of the coating resin on the core material particles and controlling the film thickness. Also, conductive fine particles can be attached on the resin coating layer for adjusting the volume resistance of the carrier. For the conductive fine particles, conductive metals or metal oxide particles such as ZnO and Al, borides such as $TiB_2$, $ZnB_2$ and $MoB_2$, $SnO_2$ which is prepared in various ways, $SnO_2$, which is doped with various elements, conductive polymers, such as carborundum, polyacetylene, poly (p-phenylene), poly (p-phenylene sulfide), polypyrrole and polyaniline, carbon blacks, such as furnace black, acetylene black, and channel black can be used.

After conductive fine particles are thrown into a solution for coating or a resin coating layer solution, these conductive fine particles can be uniformly and sufficiently dispersed into the solution by using a media-equipped-dispersion machine such as a ball mill and a beads mill, or an agitation machine equipped with fast spinning blades.

In order to enhance coat strength of the resin coating layer (coat) by giving additional strength thereto, other hard-fine-particle components can be contained into the coat. Metal oxide particles and inorganic oxide particles have particularly uniform particle diameters and effectiveness on enhancing the coat strength because of a high affinity for resin components, so they are preferably used. Known materials, such as alumina, oxidized titanium, oxidized zinc and oxidized iron can be used in separate condition or mixed with other materials for the particle material. Silica, oxidized titanium, and alumina are especially effective.

The method for injecting the metal oxide particles into the coat is explained herein. For example, solubilized polyamide (N-alkoxy-alkylated polyamide resin) can be given heat in accordance with necessity so that the it is solved into methanol, then it can be given metal oxide particles and dispersed uniformly with a dispersion machine such as a homogenizer. Then, the dispersed solution obtained from the above process can be mixed with nonaqueous solvent solution, solution prepared separately, made of condensension silicone resin having silanol group, and the mixed solution then can be dispersed uniformly with the homogenizer. The solution prepared as a coat solution by giving a proper charge adjuster and a resistance adjuster will be applied to the core material particles on the carrier.

The content of hard fine particles existing in the resin coating layer is preferably in the range of 5% by mass to 70% by mass, and more preferably 2% by mass to 40% by mass. A proper content of the hard fine particles can be selected depending on the particle diameter of the fine particle used and the specific surface area; however, the anti-abrasion effect of coat will decrease when the content is less than 5% by mass, and the occurrence of the detachment of hard fine particles will increase when the content is more than 70% by mass.

The coat strength of the resin coating layer can be further enhanced by containing an aminosilane coupling agent.

Examples of aminosilane coupling agents used in the present invention are as follows:

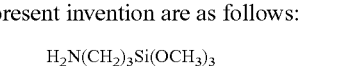

$H_2N(CH_2)_3Si(OCH_3)_3$

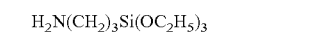

$H_2N(CH_2)_3Si(OC_2H_5)_3$

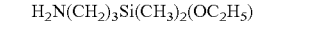

$H_2N(CH_2)_3Si(CH_3)_2(OC_2H_5)$

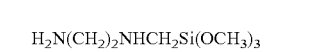

$H_2N(CH_2)_3Si(CH_3)(OC_2H_5)_2$

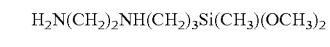

$H_2N(CH_2)_2NHCH_2Si(OCH_3)_3$

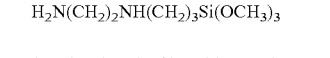

$H_2N(CH_2)_2NH(CH_2)_3Si(CH_3)(OCH_3)_2$

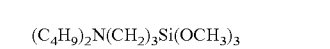

$H_2N(CH_2)_2NH(CH_2)_3Si(OCH_3)_3$

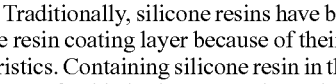

$(CH_3)_2N(CH_2)_3Si(CH_3)(OC_2H_5)_2$

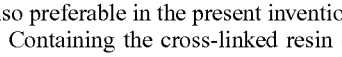

$(C_4H_9)_2N(CH_2)_3Si(OCH_3)_3$

Traditionally, silicone resins have been preferably used for the resin coating layer because of their high charging characteristics. Containing silicone resin in the resin coating layer is also preferable in the present invention.

Containing the cross-linked resin component of thermoplastic resin and guanamine resin and/or the cross-linked resin component of thermoplastic resin and melamine resin in the resin coating layer gives adequate elasticity to the resin layer, reducing toner spent on the carrier and the coat abrasion by enabling absorbing strong shocks toward the resin coating layer the shocks are caused from the friction between the coat and the toner and/or between the carriers wherein the frictions occur during the agitation process for frictional electrification on the developer.

Containing the cross-linked resin component of thermoplastic resin and guanamine resin in the resin coating layer and setting the range of the content of guanamine resin between 20% by mass and 50% by mass will provide the best elasticity to the resin of the resin coating layer. On the one hand, setting the content of the guanamine resin at 20% or more provides higher improvement on the anti-abrasion effect by making the cross-linked reaction of thermoplastic resin and guanamine effective. On the other hand, setting the content at proportion of 50% by mass or less can prevent occurrences of excess hardening of the resin coating layer, wherein hardening is caused from excess cross-linked reactions between the thermoplastic resin and the guanamine resin, resulting in making it easier to prevent the occurrence of that wherein shock absorption is kept from reaching its potential because of an insufficient elasticity of the resin coating layer, the insufficient elasticity is caused thereby.

Containing the cross-linked resin component of thermoplastic resin and melamine resin into the resin coating layer and setting the range of the content of melamine resin between 20% by mass and 50% by mass provides the best elasticity to the resin of the resin coating layer. On the one hand, setting the content of the melamine resin at 20% or more provides higher improvement on the anti-abrasion effect by making the cross-linked reaction of thermoplastic resin and melamine effective. On the other hand, setting the content at proportion of 50% by mass or less makes preventing excess hardening of the resin coating layer, wherein the hardening is caused from excess cross-linked reaction between thermoplastic resin and melamine resin easier, resulting in making easier to prevent the occurrence wherein shock absorption is kept from reaching its potential because of insufficient elasticity of the resin coating layer caused thereby.

Silicone resins and other materials can be used for the thermoplastic resin used herein, but most preferable materials are acrylic resins. All types of acrylate resins can be used here, but those having Tg in the range of 20 C.° to 100 C.°, more preferably of 25 C.° to 80 C.°, should preferably be used.

Those having Tg in the range of less than 20 C.° can cause more frequent occurrence of blocking, lowering durability at normal temperature. Those having Tg in the range of more than 100° C.° can make the resin coating layer hard, making elasticity insufficient, and can result in reducing ability to absorb shocks well.

The coating resin layer should preferably contain charge adjuster for obtaining an adequate amount of charges on the developer. Particularly, using an aromatic sulphonic acid or a phosphoric acid for charge adjuster can result in preferable reactions with guanamine resin and thus, a remarkable adjusting effect of charge can be obtained. Materials that can be used for charge adjuster are not limited to the materials mentioned here, and can include other materials, such as carbon black and/or acidic catalyst, and those materials can be used alone or in combination. Carbon black, generally used for carrier or toner, can be employed. Acidic catalyst, such as Catalyst4040 (manufactured by Mitsui Cytec Co., Ltd.), can be used. For acidic catalyst, reactive groups, such as integrity alkylation type, methylol group type, imino group type, or methylol/imino group type, can be used, but not limited to types or groups mentioned here. And they also can be used as a resistance adjuster.

The carrier of the present invention can be obtained by un-stiffening or smashing magnetic material, then classifying the crashed material so that particles of specified diameter can be obtained, and forming the resin coating layer on the surface of the classified particles, or the core material particles, obtained thereof.

Classifying includes air classification, sieve classification, or other classifications. The vibrating screen is used for carrier production, however, a traditional vibrating screen used generally have very low efficiency on classification process because of a disadvantage caused by small diameter particles that tend to become stuck in a fine screen of the screen (metallic mesh) during classification for small diameter particle. Furthermore, the process efficiency drastically decreases on classification for fine powder, allowing collecting but only 30% of the entire product. This is because the rest part of the product is mixed with particles that are removed by the classification process, increasing the cost several fold.

Given this factor, a method that gives super sonic vibration on the metallic mesh during the classification with the screen machine can be used as the way to efficiently obtain small diameter particles and cut them sharply. The method enables to efficiently obtain small particles of diameters of smaller than 20 μm and to cut them sharply.

The super sonic vibration used for vibrating the metallic mesh can be generated from converting high-frequency current into super sonic vibration through a converter. The converter, in this case, uses a PZT transducer. Super sonic vibration generated from the converter needs to be transmitted to the sympathetic vibration part fixed on the metallic mesh, so that super sonic vibration can vibrate the mesh. The sympathetic vibration part to which super sonic vibration is transmitted vibrates sympathetically, and transmits vibration and vibrates the metallic mesh on which the sympathetic vibration part is fixed. Normally, vibration frequency is in the range of 20 kHz to 50 kHz, and preferably 30 kHz to 40 kHz.

Any shape can be used as long as the shape is in an adequate form for vibrating the metallic mesh, and normally ring type is used. The vibration direction for vibrating the metallic mesh should preferably be vertical.

Figure 2:
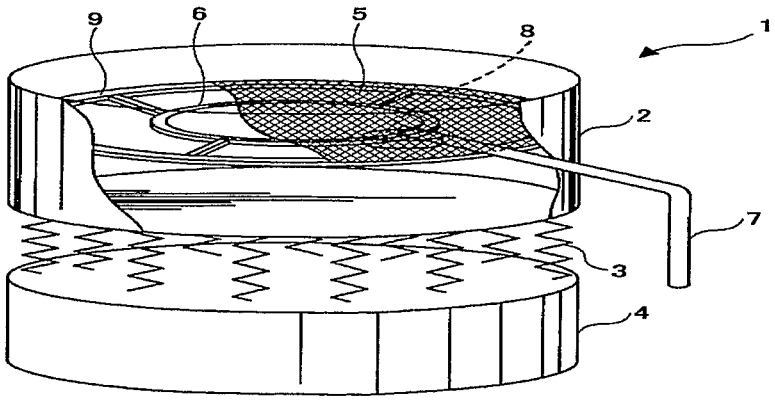
FIG. 2 shows a machine for a vibrating screen with a super sonic wave oscillator.

The machine for vibrating the screen with a super sonic wave oscillator is shown in FIG. 2. In FIG. 2, (1) represents a vibrating screener, (2) represents a cylindrical container, (3) represents springs, (4) represents a base (sustainer), (5) represents a metallic mesh, (6) represents resonant a ring, (7) represents high-frequency current cables, (8) represents a converter, and (9) represents a ring-shaped flame.

High-frequency current is supplied to the converter (8) through the cable (7) in order to activate the machine for vibrating screen with a super sonic wave oscillator (circular screener). High-frequency current supplied to the converter (8) is then converted into the super sonic wave. The super sonic wave generated from the converter (8) then vibrates the resonant ring (6) on which the converter (8) is fixed and the ring-shaped flame (9) linked to the resonant ring (6) in the vertical direction. The metallic mesh (5) fixed on the resonant ring (6) and flame (9) vibrates with the vibration transmitted from the resonant ring (6) in the vertical direction.

In the present invention, the core material particles can be obtained from classification of the smashed particles of magnetic material. Ferrite or magnetite core material particles can be obtained from classification of the primary granulated product, which is yet to be burned, burning the product, and the classification of the product.

Furthermore, the carrier can be produced from the classification of the core material particles whose surfaces are covered with the resin coating layer. Using the machine, the machine for vibrating screen with super sonic wave oscillator, at each classification stage is preferable.

The developer of the present invention can be obtained by using the carrier of the present invention and a toner. Using especially the toner, wherein the weight average particle diameter of the toner is 5 μm or less, and especially the carrier, the carrier of the present invention, provides better granularity, enabling higher quality images to be produced.

The toner used in the present invention contains a colorant, a fine particle, a charging adjuster, a releasing agent and that like in binder resin which mainly made of thermoplastic resin. Any type of known toners can be employed. The toner can be produced with toner producing methods such as a polymerization method and a granulation method, and can be in either amorphous form or spherical form. And either magnetic toner or non-magnetic toner can be used.

The following materials can be used alone or in combination for the binder resin of the toner.

Examples of materials for styrene binder resins include styrenes and homopolymer derivative substitutions of styrenes, such as polystyrene and polyvinyl toluene, styrene-p-chlorostyrene copolymers, and copolymers of styrenes, such as styrene-propylene copolymers, styrene-vinyltoluene copolymers, styrene-methyl acrylate copolymers, styrene-ethyl acrylate copolymers, styrene-butyl acrylate copolymers, styrene-methyl methacrylate copolymers, styrene-ethyl methacrylate copolymers, styrene-butyl methacrylate copolymers, styrene-α-chloromethyl methacrylate copolymers, styrene-acrylonitrile copolymers, styrene-vinyl methyl ether copolymers, styrene-vinyl methyl ketone copolymers, styrene-butadiene copolymers, styrene-isoprene copolymers, styrene-maleic acid copolymers and styrene-maleic acid ester copolymers, acrylic binders, such as methyl polymethacrylate, butyl polymethacrylate, and others, such as polyvinyl chloride, polyvinyl acetate, polyethylene, polypropylene, polyester, polyurethane, epoxy resin, polyvinyl butyral, polyacrylic acid resins, rosins, modified rosins, terpene resins, phenol resins, alicyclic or aliphatic hydrocarbon resins, aromatic petroleum resins, chlorinated paraffins, and paraffin waxes.

Of these, polyester resins are particularly preferable in terms that the melt viscosity can be reduced while ensuring the storage stability of a toner as compared to styrene resins and acrylic resins. This type of polyesters can be obtained, for example, from the polycondensation reaction between alcohols and carboxylic acids.

Examples of the alcohols include diols, such as polyethylene glycol, diethylene glycol, triethylene glycol, 1,2-propylene glycol, 1,3-propylene glycol, 1,4-propylene glycol, neopentyl glycol and 1,4-butene diol; etherified bisphenols such as 1,4-bis(hydroxymethyl)cyclohexane, bisphenol A, hydrogenated bisphenol A, polyoxy-ethylenated bisphenol A, polyoxy-propylenated bisphenol A; divalent alcohol monomers wherein each of the above-mentioned alcohol components is substituted by a saturated or unsaturated hydrocarbon group having 3 to 22 carbon atoms, other divalent alcohol monomers; and trivalent or more high-alcohol monomers such as sorbitol, 1,2,3,6-hexane tetrol, 1,4-sorbitan, pentaerythritol, dipentaerythritol, tripentaerythritol, sucrose, 1,2,4-butanetriol, 1,2,5-pentanetriol, glycerol, 2-methylpropane triol, 2-methyl-1,2,4-butanetriol, trimethylol ethane, trimethylol propane, and 1,3,5-trihydroxymethyl benzene.

Examples of the carboxylic acids used for polyester resins include monocarboxylic acids such as palmitic acid, stearic acid, and oleic acid; maleic acid, fumaric acid, mesaconic acid, citraconic acid, terephthalic acid, cyclohexane dicarboxylic acid, succinic acid, adipic acid, sebacic acid, malonic acid; divalent organic acid monomers that each of the above-noted carboxylic acid components is substituted by a saturated or unsaturated hydrocarbon group having 3 to 22 carbon atoms; anhydrides thereof dimer acids contain a lower alkyl ester and a linolenic acid; 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 3,3-dicarboxy methyl butane acid, tetracarboxy methyl methane; 1,2,7,8-octanetetracarboxylic enball trimer acid, and trivalent or more polyvalent carboxylic acid monomers such as anhydrides of these acids.

For the epoxy resin, epoxy resins polycondensation products between bisphenol A and epichlorohydrin etc, can be used, and specific examples of commercially available epoxy resins include Epomic R362, R364, R365, R366, R367, and R369 (all manufactured by MITSUI OIL CO., LTD.); Epotote YD-011, YD-012, YD-014, YD-904, and YD-017 (all manufactured by Tohto Kasei Co., Ltd.); and Epocoat 1002, 1004, and 1007 (all manufactured by Shell Chemicals Japan Ltd.).

The colorants used in the present invention include of known dyes and pigments, they can be used alone or in combination, and the examples of the dyes and pigments include carbon black, ramp black, iron black, ultramarine blue, nigrosine staining, aniline blue, phthalocyanine, hansa yellow G, rhodamine 6G lake, calco oil blue, chrome yellow, quinacridone, benzin yellow, rose Bengal, triarylmethane stainings, monoazos, disazos, and other types of dyes and pigments.

The toner can be a magnetic toner by adding magnetic material thereto. The magnetic material can employ ferromagnetic materials, such as iron and cobalt, and fine particles, such as magnetite fine particles, hematite fine particles, Li ferrite fine particles, Mn—Zn ferrite fine particles, Cu—Zn ferrite fine particles, Ni—Zn ferrite fine particles and Ba ferrite fine particles.

In order to give sufficient control on the frictional electrification of the toner, a so-called charging adjuster, metallic complex amino compounds such as a metal complex salt of monoazo staining, nitrohumic acid and the salt thereof, salicylic acid, naphthoic acid or dicarboxylic acid metallic complex of Co, Cr or Fe, amino compound, quaternary ammonium compound, or organic dye can be contained.

The releasing agent can be added to the toner if necessary.

Low-molecular weight polypropylene, low-molecular weight polyethylene, carnauba waxes, microcry stalline waxes, jojoba waxes and rice waxes are examples that can be used alone or in combination for the releasing agent. The wax material is not limited to those waxes listed here.

An external additive can be added to the toner. The toner must have flowability in order to obtain a high-quality image. To impart flowability to the toner, it is typically effective to add particles such as inorganic particles and hydrophobic-treated inorganic particles, however, the hydrophobic-treated primary particles should preferably contain inorganic particles wherein the average particle diameter is in the range of 1 μm to 100 μm, and more preferably 5 μm to 70 μm. The specific surface area of the inorganic particles based on BET method should preferably be in the range of 20 $m^2/g$ to 500 $m^2/g$.

The following materials can be used if certain conditions are met. Examples are fine silica particles, hydrophobized silica, fatty acid metal salts such as zinc stearate and aluminum stearate, metal oxides, such as titania, alumina, tin oxide and antimony oxide, and fluoropolymer may be contained.

Especially preferable external additives are hydrophobized silica, titania, alumina fine particles. Examples of silica fine particle are HDK H 2000, HDK H 2000/4, HDK H 2050 EP, HVK 21, HDK H 1303 (all manufactured by Clariant Japan K. K.), R972, R974, RX 200, RY200, R202, R805 and R812 (all manufactured by Nippon AEROSIL Co., Ltd.). Examples of titania fine particle are STT-30, STT-65C-S (all manufactured by Titankogyo Co., Ltd.), TAF-140 (manufactured by Fuji Titanium Industry Co., Ltd.), MT-150W, MT-500B, MT-600B and MT-150A (all manufactured by Tayca Corporation). Particularly, examples of hydrophobized titanic oxide are T-805 (Nippon AEROSIL Co., Ltd.), STT-30A, STT-65S-S (all manufactured by Titankogyo Co., Ltd.), TAF-500T, TAF-1500T (all manufactured by Fuji Titanium Industry Co., Ltd.), MT-100S, MT-100T (all manufactured by Tayca Corporation) and IT-S (manufactured by ISHIHARA SANGYO KAISHA, Ltd).

The hydrophobized silica particles, fine titania particles and fine alumina particles can be obtained from the process wherein hydrophilic particles are treated with an aminosilane coupling agent, such as methyl trimethoxy silane, methyl triethoxy silane or octyl trimethoxy silane.

The toner used in the present invention should preferably have weight average particle diameter (Dw) in the range of 3.0 μm to 9.0 μm and more preferably 3.5 μm to 7.5 μm, but it is not limited to the value herein. The content of the toner relative to carrier is not particularly limited and may be suitably selected in accordance with the intended use; however, it is preferably 2 parts by mass to 25 parts by mass relative to 100 parts by mass of the carrier, and more preferably 2 parts by mass to 20 parts by mass.

In addition, the particle diameters of the toner can be measured with a call counter (manufactured by Call Counter Ltd.).

In the present invention, wherein the carrier of the present invention is used, the toner has charge amount in the range of 10 μC/g to 50 μC/g when the carrier coverage of the toner is 50%, the weight average particle diameter is in the range of 3.5 mμ to 7.5 μm, the distance between the developing sleeve and the image bearing member is 0.4 mm or less, and alternate current is applied as the developing bias, high quality images will be obtained therethrough less occurrence of carrier adhesion.

The image forming method of the present invention is a method to develop a latent image using the developer of the present invention. Sufficient image densities can be obtained by applying voltage therethrough, wherein direct current voltage is superimposed with alternate current voltage, is applied as an external developing bias. Especially, preferable granularity at highlight parts can be obtained.

Higher image densities can be obtained because of improvements of carrier adhesion and edge effect as well as increase of the background smear margins, therefore, the charge amount of toner and the developing bias decrease, and the toner coverage relative to the carrier increases, enabling to provide higher image density.

The process cartridge of the present invention has at least an image bearing member and a developing unit configured to develop a latent electrostatic image formed on the image bearing member by using the developer of the present invention to form a visible image, and can be detachably attached to the body of the image forming apparatus. The process cartridge may be further integrally provided with a charging unit configured to charge the surface of the image bearing member, such as a charge brush; and a cleaning unit such as a blade which is configured to remove a residual developer remaining on the image bearing member surface.

Next, the image forming method and the image forming apparatus of the present invention will be described in detail referring to drawings, however, these examples are described for explaining the present invention and are not intended to limit the scope of the present invention.

Figure 3:
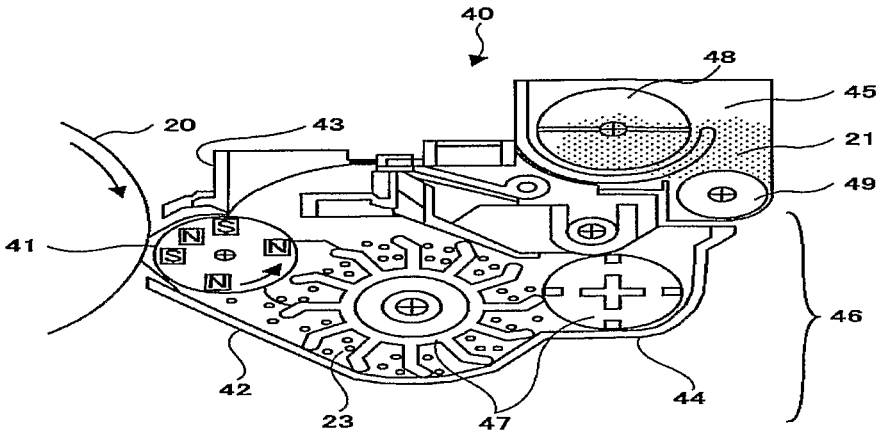
FIG. 3 shows an image developing unit used in the present invention.

FIG. 3 is a view schematically showing one example of an image developing unit used in the present invention, and modified examples which will be hereinafter described are also included within the spirit and scope of the present invention.

In FIG. 3, an image developing unit 40 is arranged so as to face an image bearing member 20, and the image developing unit 40 is primarily composed of a developing sleeve 41 serving as a developer bearing member, a developer housing member 42, a doctor blade 43 serving as a controlling member, and a support case 44.

To the support case 44 which has an aperture on the side of the image bearing member 20, a toner hopper 45 serving as a toner housing part for housing a toner 21 inside thereof is fitted. In a developer housing part 46 which is located adjacent to the toner hopper 45 and is configured to house a developer containing the toner and a carrier 23, a developer agitating mechanism 47 is provided, and the developer agitating mechanism 47 serves to agitate the toner 21 and the carrier 23 as well as to give a frictional charge or a stripping charge to the toner.

Inside the toner hopper 45, a toner agitator 48 as a toner supplying unit which is rotated by a driving unit (not shown), and a toner supplying mechanism 49 are arranged. The toner agitator 48 and the toner supplying mechanism 49 are configured to send the toner 21 residing in the toner hopper 45 toward the developer housing part 46 while agitating the toner 21.

In a space between the image bearing member 20 and the toner hopper 45, the developing sleeve 41 is arranged. The developing sleeve 41 which is driven to rotate in the direction indicated by the arrow in the figure by means of a driving unit (not shown) has a magnet (not shown) serving as a magnetic field generating unit which is inalterably located at a relative position to the image developing unit 40 inside of the developing sleeve 41.

The doctor blade 43 is integrally attached to the developer housing member 42 on the opposite position where the developer housing member 42 is attached to the support case 44. The doctor blade 43 is arranged, in this example, in a state where an interspace with a certain distance is kept between the edge of the doctor blade 43 and the outer circumference surface of the developing sleeve 41.

Using such an image developing unit in an unlimited manner, the image forming method of the present invention is carried out as follows. The toner 21 sent out from the inside of the toner hopper 45 by action of the toner agitator 48 and the toner supplying mechanism 49 is conveyed to the developer housing part 46. Then, the toner 21 is agitated by means of a developer agitating mechanism 47, and the agitation force gives the toner 21 a desired frictional charge or a stripping charge, and the toner 21 is carried on the developing sleeve 41 together with the carrier 23 as a developer to be conveyed at the opposed position to the outer circumferential surface of the image bearing member 20, and then only the toner 21 is electrostatically bound to a latent electrostatic image formed on the surface of the image bearing member 20 to thereby form a toner image on the image bearing member 20.

Figure 4:
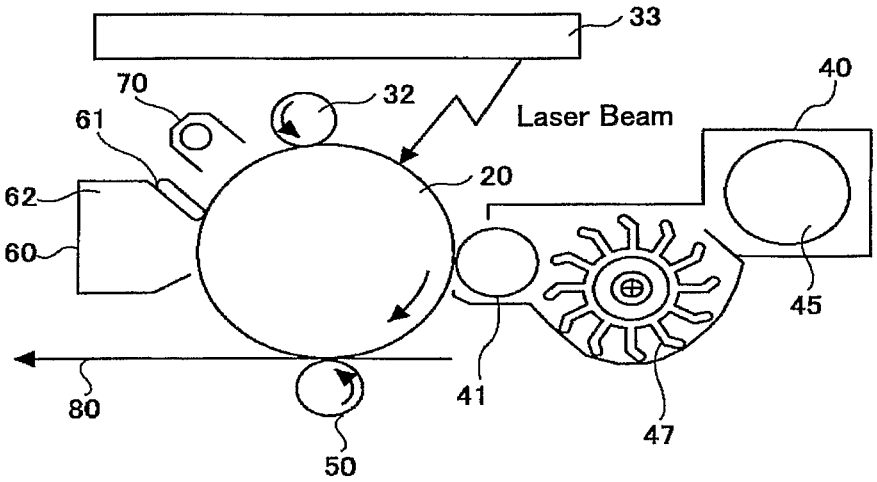
FIG. 4 shows one example of an image forming apparatus having the image developing unit of FIG. 3.

FIG. 4 is a view schematically showing one example of an image forming apparatus equipped with the image developing unit shown in FIG. 3. Around the drum-shape image bearing member 20, a charge member 32, an image exposing system 33, the image developing unit 40, an image transferer 50, a cleaner 60, and a charge elimination lamp 70 are located. In this case, the surface of the charge member 32 is arranged in a noncontact state with the surface of the image bearing member 20 spacing approximately 0.2 mm, and when the image bearing member is charged through the use of the charge member 32, the surface of the image bearing member 20 is charged with an electric field in which an alternate current component is superimposed to a direct current component by using a voltage application unit which is not shown in the charge member 32. With this configuration, it is possible to reduce nonuniformity of charge, and the surface of the image bearing member 20 can be effectively charged. The image forming method including a developing method is performed with the following operations.

A series of the image forming steps can be explained using a negative-positive process. An image bearing member 20 typified by an organic image bearing member (OPC) having an organic photoconductive layer is charge-eliminated using a charge elimination lamp 70 and is uniformly negatively charged by a charge member 32 such as an electric charger or a charge roller to form a latent image by means of a laser beam applied from an image exposing system 33 such as a laser optical system (in this case, the absolute value of the potential of exposed areas is lower than that of unexposed areas).

A laser beam is emitted from a semiconductor laser to scan the surface of the image bearing member 20 in the direction of the rotational axis of the image bearing member 20 using a polygonal mirror in a shape of polygonal pole, which is rotating at a high speed to form a latent image on the image bearing member surface. The latent image formed in this way is developed using a developer which contains a mixture of a toner and a carrier and is supplied to a developing sleeve 41 serving as a developer bearing member in the image developing unit 40 to thereby form a toner image. When the latent image is developed, a developing bias of an appropriate amount of direct current voltage or an alternate current voltage superposed to the direct current voltage is applied from a voltage applying mechanism (not shown) through the developing sleeve 41 to areas between exposed areas and unexposed areas on the image bearing member 20.

Meanwhile, a recording medium 80 (for example, paper) is fed and sent from a sheet feeding mechanism (not shown) to be synchronized with the edge of an image at the position of a pair of resist rollers (not shown) to be sent in between the image bearing member 20 and an image transferer 50 to thereby transfer a toner image onto the recording medium 80. At this point, it is preferable that an electrical potential of a reverse polarity from the polarity of the toner charge be applied as a transfer bias to the image transferer 50. Thereafter, the recording medium 80 is separated from the image bearing member 80 to allow obtaining a transferring image.

A residual toner remaining on the image bearing member 20 is collected to a toner collection chamber 62 within a cleaner 60 by action of a cleaning blade 61 as a cleaning member.

The collected toner may be conveyed to a developer housing part (not shown) and/or a toner hopper 45 by action of a toner recycling unit (not shown) to be reused.

The image forming apparatus may be an apparatus wherein a plurality of the image developing unit described above are arranged to sequentially transfer a toner image onto a recording medium, and the toner image is sent to a fixing mechanism to be fixed by heat, etc., or may be an apparatus wherein a plurality of toner images are transferred onto an intermediate recording medium once, and the toner images on the intermediate recording medium are transferred onto a recording medium at a time to be fixed in a similar manner as mentioned above.

Figure 5:
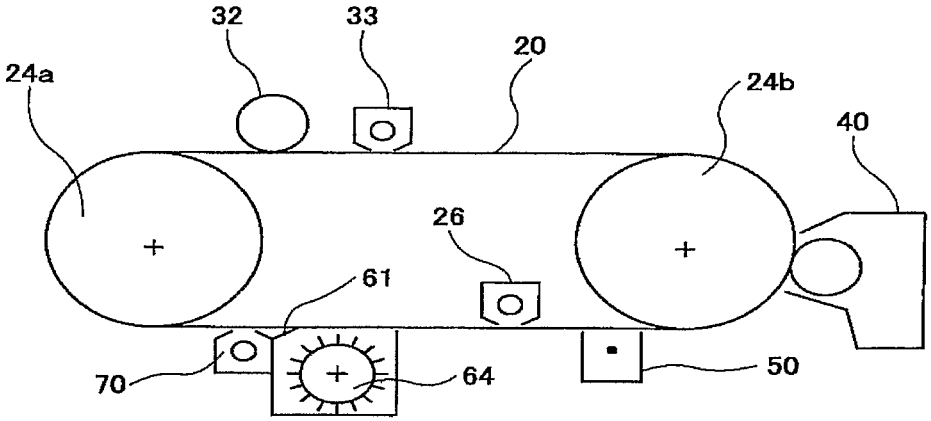
FIG. 5 shows another example of the image forming method used in the present invention.

FIG. 5 is a view schematically showing another example of an image forming apparatus used in the present invention. The image bearing member 20 is provided with at least a photosensitive layer on a conductive support and is driven by action of driving rollers 24*a* and 24*b*. In the image forming apparatus, the surface of the image bearing member is charged by using the charge member 32, an image is exposed on the image bearing member surface by using the image exposing optical system 33, the image is developed by using the image developing unit 40, the developed image is transferred onto a recording medium by using the image transferer 50 having a corona charger, pre-cleaning exposure is performed by using a pre-cleaning exposure light source 26, a residual toner is cleaned by using a brush-shaped cleaning unit 64 and the cleaning blade 61, and the image bearing member surface is charge eliminated by using a charge elimination lamp 70. The above-mentioned process is repeatedly performed. In an image forming apparatus shown in FIG. 4, the image bearing member 20 (in this case, the support is translucent) is subjected to a pre-cleaning exposure treatment from the support side.

Figure 6:
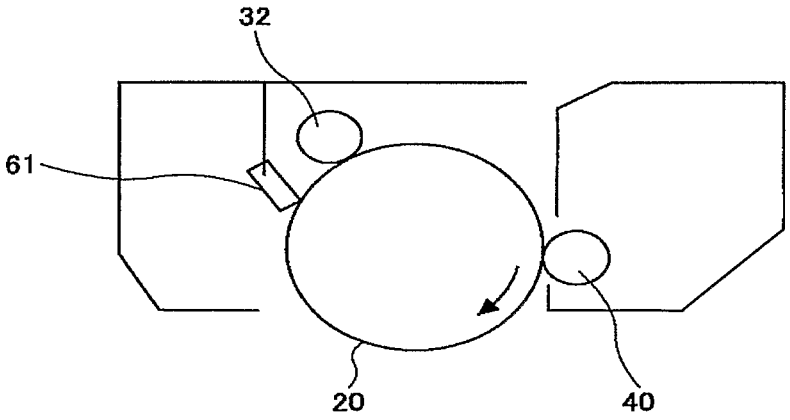
FIG. 6 shows one example of the process cartridge of the present invention.

FIG. 6 is a view schematically showing one example of a process cartridge of the present invention. The process cartridge has at least the image bearing member 20, the brush-shaped charge member 32, the image developing unit 40, wherein the developer of the present invention is contained, and a cleaning unit at least having the cleaning blade 61, and the process cartridge can be detachably attached to the body of an image forming apparatus. The process cartridge of the present invention has each of the above-mentioned components as a process cartridge, and the process cartridge can be detachably attached to the body of an image forming apparatus, such as a copier or a printer.

Hereafter, the present invention will be further described in detail referring to Examples and Comparative Examples; however, the present invention is not limited to the disclosed examples. It should be noted that "part" or "parts" represents "part by mass" or "parts by mass", unless otherwise indicated.

PRODUCTION EXAMPLE OF TONER

Polyester resin: 100 parts

Quinacridone magenta pigment: 3.5 parts

Fluorine-containing quaternary ammonium salt: 3.5 parts

The components stated above were sufficiently mixed together using a blender, and the mixture was fused and kneaded using a biaxial extruder. The kneaded product was standing to cool, and the cooled product was coarsely crushed using a cutter mill. Next, the coarsely crushed product was finely pulverized in a jet stream pulverizing mill, and the pulverized powder was classified using an air classifier to thereby obtain toner base particles having the weight average particle diameter of 6.8 μm and an absolute density of 1.22 g/cm$^3$.

Next, to 100 parts of the obtained toner base particles, 0.8 parts of hydrophobized silica fine particles (R972 manufactured by Nippon AEROSIL CO., LTD.) was added, and the components were mixed and then sieved to thereby prepare a toner.

PRODUCTION EXAMPLE OF CARRIER

Production Example 1

Silicone resin solution (solid content of 20% by mass): 75 parts
(SR2411, manufactured by DOW CORNING TORAY SILICON CO., LTD.)

Acrylate resin solution (solid content of 50% by mass): 10 parts
(Hitaroide3001, Manufactured by Hitachi Chemical Co., Ltd.)

Toluene: 100 parts

Butyl cellosolve: 100 parts

In order to make resin coating layer forming solution, the components stated above are mixed and fused with a homomixer for 10 minutes. The core material particles (A) in Table 1 were used, the surface of the core material particles are coated with resin coating layer forming solution with a Spilacoater (manufactured by OKADA SEIKO CO., LTD), forming the layer of 0.3 μm in thickness under the condition wherein temperature is 55° C. and forming rate is 30 g/minute. And then the particles are dried. The layer thickness is controlled with the amount of the solution. The carrier obtained from the previous process is then burned in an electric furnace at temperature of 150° C. for 1 hour, and then after it is cooled, smashed with a sieve whose opening is 100 μm. Table 2 shows the physicality of the carrier after this process.

TABLE 1

| Core Material Particles | Dw [μm] | Dw/Dp | The content of particles of 20 μm or smaller [% by mass] | The content of particles of 36 μm or smaller [% by mass] | Particle density [g/cm$^3$] | True density [g/cm$^3$] | Particle density/ True density × 100 | Magnetization [emu/g] | Core material |
|---|---|---|---|---|---|---|---|---|---|
| A | 22.1 | 1.12 | 6.8 | 93.4 | 4.45 | 5.19 | 85.74 | 48 | Cu—Zn ferrite |
| B | 31.2 | 1.18 | 5.5 | 90.2 | 4.44 | 5.19 | 85.55 | 48 | Cu—Zn ferrite |
| C | 21.2 | 1.11 | 6.8 | 94.5 | 4.46 | 5.19 | 85.93 | 48 | Cu—Zn ferrite |
| D | 32.0 | 1.17 | 5.6 | 90.5 | 4.47 | 5.19 | 86.13 | 48 | Cu—Zn ferrite |
| E | 31.0 | 1.22 | 5.6 | 90.4 | 4.45 | 5.19 | 85.74 | 48 | Cu—Zn ferrite |
| F | 22.2 | 1.13 | 7.2 | 93.5 | 4.46 | 5.19 | 85.93 | 48 | Cu—Zn ferrite |
| G | 31.1 | 1.17 | 5.4 | 88.9 | 4.46 | 5.19 | 85.93 | 48 | Cu—Zn ferrite |
| H | 22.0 | 1.12 | 6.7 | 93.3 | 4.39 | 5.19 | 84.59 | 48 | Cu—Zn ferrite |
| I | 26.4 | 1.15 | 6.2 | 91.6 | 4.49 | 5.19 | 86.51 | 48 | Cu—Zn ferrite |
| J | 26.5 | 1.15 | 6.3 | 91.5 | 4.54 | 5.19 | 87.48 | 48 | Cu—Zn ferrite |
| K | 26.6 | 1.15 | 6.1 | 91.4 | 4.98 | 5.19 | 95.95 | 48 | Cu—Zn ferrite |
| L | 26.3 | 1.15 | 6.2 | 91.5 | 5.04 | 5.19 | 97.11 | 48 | Cu—Zn ferrite |
| M | 26.7 | 1.14 | 6.4 | 91.8 | 4.55 | 5.20 | 87.50 | 52 | Cu—Zn ferrite |
| N | 30.1 | 1.18 | 6.6 | 90.2 | 7.12 | 7.81 | 91.17 | 99 | Iron Powder |

TABLE 1-continued

| Core Material Particles | Dw [μm] | Dw/Dp | The content of particles of 20 μm or smaller [% by mass] | The content of particles of 36 μm or smaller [% by mass] | Particle density [g/cm$^3$] | True density [g/cm$^3$] | Particle density/ True density × 100 | Magnetization [emu/g] | Core material |
|---|---|---|---|---|---|---|---|---|---|
| O | 30.5 | 1.17 | 6.5 | 90.3 | 7.21 | 7.80 | 92.44 | 102 | Iron Powder |
| P | 27.1 | 1.16 | 6.3 | 91.2 | 4.79 | 4.88 | 98.16 | 74 | Magnetite |
| Q | 27.3 | 1.16 | 6.4 | 92.1 | 4.87 | 4.98 | 97.79 | 76 | Mn ferrite |
| R | 26.9 | 1.16 | 6.3 | 91.8 | 4.72 | 4.88 | 96.72 | 75 | Mn—Mg—Sr ferrite |

TABLE 2

| | Core Material Particles | Dw [μm] | Dw/Dp | The content of particles of 20 μm or smaller [% by mass] | The content of particles of 36 μm or smaller [% by mass] | Magnetization [emu/g] | Volume resistivity [Ω · cm] |
|---|---|---|---|---|---|---|---|
| Production Ex. 1 | A | 22.7 | 1.12 | 6.7 | 93.5 | 48 | 3.42E+16 |
| Production Ex. 2 | B | 31.8 | 1.18 | 5.4 | 90.3 | 48 | 3.15E+16 |
| Production Ex. 3 | C | 21.8 | 1.11 | 6.8 | 94.6 | 48 | 3.44E+16 |
| Production Ex. 4 | D | 32.6 | 1.17 | 5.5 | 90.6 | 48 | 3.20E+16 |
| Production Ex. 5 | E | 31.6 | 1.22 | 5.5 | 90.5 | 48 | 2.99E+16 |
| Production Ex. 6 | F | 22.8 | 1.13 | 7.1 | 93.6 | 48 | 3.22E+16 |
| Production Ex. 7 | G | 31.7 | 1.17 | 5.3 | 89.1 | 48 | 3.31E+16 |
| Production Ex. 8 | H | 22.6 | 1.12 | 6.6 | 93.4 | 48 | 3.44E+16 |
| Production Ex. 9 | I | 27.0 | 1.15 | 6.1 | 91.8 | 48 | 3.22E+16 |
| Production Ex. 10 | J | 27.1 | 1.15 | 6.2 | 91.6 | 48 | 3.51E+16 |
| Production Ex. 11 | K | 27.2 | 1.15 | 6.0 | 91.5 | 48 | 3.11E+16 |
| Production Ex. 12 | L | 26.9 | 1.15 | 6.1 | 91.6 | 48 | 3.05E+16 |
| Production Ex. 13 | M | 27.3 | 1.14 | 6.3 | 92.0 | 52 | 3.21E+16 |
| Production Ex. 14 | N | 30.7 | 1.18 | 6.4 | 90.3 | 99 | 3.02E+16 |
| Production Ex. 15 | O | 31.1 | 1.17 | 6.5 | 90.4 | 102 | 3.10E+16 |
| Production Ex. 16 | P | 27.7 | 1.16 | 6.2 | 91.3 | 74 | 3.34E+16 |
| Production Ex. 17 | Q | 27.9 | 1.16 | 6.3 | 92.2 | 76 | 2.91E+16 |
| Production Ex. 18 | R | 27.5 | 1.16 | 6.2 | 91.9 | 75 | 2.97E+16 |
| Production Ex. 19 | Q | 27.9 | 1.16 | 6.3 | 92.2 | 76 | 8.50E+15 |
| Production Ex. 20 | Q | 27.9 | 1.16 | 6.3 | 92.2 | 76 | 3.42E+11 |
| Production Ex. 21 | Q | 27.9 | 1.16 | 6.3 | 92.2 | 76 | 5.68E+10 |
| Production Ex. 22 | Q | 28.0 | 1.16 | 6.3 | 92.2 | 76 | 6.14E+15 |
| Production Ex. 23 | Q | 28.0 | 1.16 | 6.3 | 92.2 | 76 | 5.97E+15 |
| Production Ex. 24 | Q | 28.0 | 1.16 | 6.3 | 92.2 | 76 | 6.22E+15 |
| Production Ex. 25 | Q | 28.0 | 1.16 | 6.3 | 92.2 | 76 | 5.88E+15 |
| Production Ex. 26 | Q | 27.9 | 1.16 | 6.3 | 92.2 | 76 | 6.02E+15 |
| Production Ex. 27 | Q | 27.9 | 1.16 | 6.3 | 92.2 | 76 | 6.08E+15 |
| Production Ex. 28 | Q | 28.1 | 1.16 | 6.3 | 92.2 | 76 | 5.99E+15 |
| Production Ex. 29 | Q | 28.1 | 1.16 | 6.3 | 92.2 | 76 | 6.31E+15 |
| Production Ex. 30 | Q | 27.9 | 1.16 | 6.3 | 92.2 | 76 | 4.11E+15 |
| Production Ex. 31 | Q | 27.9 | 1.16 | 6.3 | 92.2 | 76 | 3.87E+15 |
| Production Ex. 32 | Q | 27.9 | 1.16 | 6.3 | 92.2 | 76 | 4.05E+15 |
| Production Ex. 33 | Q | 27.9 | 1.16 | 6.3 | 92.2 | 76 | 3.90E+15 |

Production Example 2

All conditions were the same as those in Production Example 1, except that the core material particles B in Table 1 were used, and a carrier was obtained.

Production Example 3

All conditions were the same as those in Production Example 1, except the core material particles C in Table 1 were used, and a carrier was obtained.

Production Example 4

All conditions were the same as those in Production Example 1, except that the core material particles D in Table 1 were used, and a carrier was obtained.

Production Example 5

All conditions were the same as those in Production Example 1, except that the core material particles E in Table 1 were used, and a carrier was obtained.

Production Example 6

All conditions were the same as those in Production Example 1, except that the core material particles F in Table 1 were used, and a carrier was obtained.

Production Example 7

All conditions were the same as those in Production Example 1, except that the core material particles G in Table 1 were used, and a carrier was obtained.

Production Example 8

All conditions were the same as those in Production Example 1, except that the core material particles H in Table 1 were used, and a carrier was obtained.

Production Example 9

All conditions were the same as those in Production Example 1, except that the core material particles I in Table 1 were used, and a carrier was obtained.

Production Example 10

All conditions were the same as those in Production Example 1, except that the core material particles J in Table 1 were used, and a carrier was obtained.

Production Example 11

All conditions were the same as those in Production Example 1, except that the core material particles K in Table 1 were used, and a carrier was obtained.

Production Example 12

All conditions were the same as those in Production Example 1, except that the core material particles L in Table 1 were used, and a carrier was obtained.

Production Example 13

All conditions were the same as those in Production Example 1, except that the core material particles M in Table 1 were used, and a carrier was obtained.

Production Example 14

All conditions were the same as those in Production Example 1, except that the core material particles N in Table 1 were used, and a carrier was obtained.

Production Example 15

All conditions were the same as those in Production Example 1, except that the core material particles O in Table 1 were used, and a carrier was obtained.

Production Example 16

All conditions were the same as those in Production Example 1, except that the core material particles P in Table 1 were used, and a carrier was obtained.

Production Example 17

All conditions were the same as those in Production Example 1, except that the core material particles Q in Table 1 were used, and a carrier was obtained.

Production Example 18

All conditions were the same as those in Production Example 1, except that the core material particles R in Table 1 were used, and a carrier was obtained.

Production Example 19)

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Charging adjuster (carbon black): 2 parts
Toluene: 100 parts
Butyl cellosolve: 100 parts All conditions were the same as those in Production Example 17, except that the above-mentioned materials were used for resin coating layer forming solution, and a carrier was obtained.

Production Example 20

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Charging adjuster (carbon black): 10 parts
Toluene 100: parts
Butyl cellosolve: 100 parts All conditions were the same as those in Production Example 17, except that the above-mentioned materials were used for resin coating layer forming solution, and a carrier was obtained.

Production Example 21

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Charging adjuster (carbon black): 12 parts
Toluene: 100 parts
Butyl cellosolve: 100 parts All conditions were the same as those in Production Example 17, except that the above-mentioned materials were used for resin coating layer forming solution, and a carrier was obtained.

Production Example 22

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)

Charging adjuster (carbon black): 2 parts
Zinc oxide fine particles: 15 parts
Toluene: 100 parts
Butyl cellosolve: 100 parts All conditions were the same as those in Production Example 17, except that the above-mentioned materials were used for resin coating layer forming solution, and a carrier was obtained.

Production Example 23

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Charging adjuster (carbon black): 2 parts
Silica particles: 15 parts
Toluene: 100 parts
Butyl cellosolve: 100 parts All conditions were the same as those in Production Example 17, except that the above-mentioned materials were used for resin coating layer forming solution, and a carrier was obtained.

Production Example 24

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Charging adjuster (carbon black): 2 parts
Titania particles: 15 parts
Toluene: 100 parts
Butyl cellosolve: 100 parts All conditions were the same as those in Production Example 17, except the above-mentioned materials were used for resin coating layer forming solution, and a carrier was obtained.

Production Example 25

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Charging adjuster (carbon black): 2 parts
Alumina particles: 15 parts
Toluene: 100 parts
Butyl cellosolve: 100 parts All conditions were the same as those in Production Example 17, except that the above-mentioned materials were used for resin coating layer forming solution, and a carrier was obtained.

Production Example 26)

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Charging adjuster (carbon black): 2 parts
Alumina particles: 4.9 parts
Toluene: 100 parts
Butyl cellosolve: 100 parts All conditions were the same as those in Production Example 17, except that the above-mentioned materials were used for resin coating layer forming solution, and a carrier was obtained.

Production Example 27)

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Charging adjuster (carbon black): 2 parts
Alumina particles: 5.1 parts
Toluene: 100 parts
Butyl cellosolve: 100 parts All conditions were the same as those in Production Example 17, except that the above-mentioned materials were used for resin coating layer forming solution, and a carrier was obtained.

Production Example 28

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Charging adjuster (carbon black): 2 parts
Alumina particles: 69.9 parts
Toluene: 100 parts
Butyl cellosolve: 100 parts All conditions were the same as Production Example 17, except that the above-mentioned materials were used for resin coating layer forming solution, and a carrier was obtained.

Production Example 29

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Charging adjuster (carbon black): 2 parts Alumina particles: 70.1 parts
Toluene: 100 parts
Butyl cellosolve: 100 parts All conditions were the same as those in Production Example 17, except that the above-mentioned materials were used for resin coating layer forming solution, and a carrier was obtained.

Production Example 30

Silicone resin solution (solid content of 20% by mass): 75 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Charging adjuster (carbon black): 2 parts
Aminosilane coupling agent: 1.5 parts ($H_2N(CH_2)_3Si(OCH_3)_3$)
Alumina particles: 15 parts
Toluene: 100 parts
Butyl cellosolve: 100 parts All conditions were the same as those in Production Example 17, except that the above-mentioned materials were used for resin coating layer forming solution, and a carrier was obtained.

Production Example 31

Silicone resin solution (solid content of 20% by mass): 75 parts
(SR2411, manufactured by DOW CORNING TORAY SILICON CO., LTD.)
Guanamine resin solution (solid content of 77% by mass): 6.5 parts
(Mycoat106, manufactured by manufactured by Mitsui Cytec Co., Ltd.)
Charging adjuster (carbon black): 2 parts
Aminosilane coupling agent: 1.5 parts ($H_2N(CH_2)_3Si(OCH_3)_3$)

Alumina particles: 15 parts
Toluene: 100 parts
Butyl cellosolve: 100 parts

All conditions were the same as those in Production Example 17, except that the above-mentioned materials were used for resin coating layer forming solution, and a carrier was obtained.

Production Example 32

Silicone resin solution (solid content of 20% by mass): 50 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Guanamine resin solution (solid content of 77% by mass): 6.5 parts
(Mycoat106, manufactured by manufactured by Mitsui Cytec Co., Ltd.)
Charging adjuster (carbon black): 2 parts
Aminosilane coupling agent: 1.5 parts ($H_2N(CH_2)_3Si(OCH_3)_3$)

Alumina particles: 15 parts
Toluene: 100 parts
Butyl cellosolve: 100 parts

All conditions were the same as those in Production Example 17, except that the above-mentioned materials were used for resin coating layer forming solution, and a carrier was obtained.

Production Example 33

Silicone resin solution (solid content of 20% by mass): 50 parts
(SR2411, manufactured by DOW CORNING TORAY SILICON CO., LTD.)
Acrylate resin solution (solid content of 50% by mass): 10 parts
(Hitaroide 3001, manufactured by Hitachi Chemical Co., Ltd.)
Melamine resin solution (volatile portions of 0% by mass): 5 parts
(Simel303, manufactured by manufactured by Mitsui Cytec Co., Ltd.)
Charging adjuster (carbon black): 2 parts
Aminosilane coupling agent: 1.5 parts ($H_2N(CH_2)_3Si(OCH_3)_3$)
Alumina particles: 15 parts
Toluene: 100 parts
Butyl cellosolve: 100 parts All conditions were the same as those in Production Example 17, except that the above-mentioned materials were used for resin coating layer forming solution, and a carrier was obtained.

Comparative Example and Example

Mixing 7 parts of the toner obtained at Production Example of Toner and 93 parts of the carriers obtained at Production Example of Carrier 1-33 for 10 minutes, and a developer was obtained.

Image forming process was implemented with the developer to test image quality (background smear and granularity), carrier adhesion margin and background smear after 50,000 sheets of paper were printed. The images were formed with Imagio Color 4000, a digital color copier/printer complex unit manufactured by Richo, under the following condition.

Developing gap (the distance between the image bearing member and the developing sleeve): 0.35 mm Doctor gap (the distance between the developing sleeve and the doctor): 0.65 mm Liner speed of the image bearing member: 200 mm/sec.

Liner speed of the developing sleeve/liner speed of the image bearing member: 1.80

Writing density: 600 dpi

Charge potential (Vd): −600V

Charge of printed image (solid part) after exposed (V1): −150V

Developing bias: DC component: −500V/alternate current bias component: 2 kHz, −100V to +900V, 50% duty An Image forming is conducted with the following test method:

(1) Background Smear

The degree of contamination (smear) of background portions of the image was visually checked. Marks A-E of Table 3 respectively represent:

A: very excellent
B: excellent
C: no problems
D: allowable to use
E: poor (unallowable level)

(2) Granularity (Uniformity of High-Light Part)

The granularity defined by the following equation (brightness range: 50 to 80) on transfer paper was measured and evaluated in accordance with the following criteria.

$$\text{Granularity}=\exp(aL+B)\int(WS(f)^{1/2}\cdot VTF(f)df$$

L: average brightness
f: space frequency (cycle/mm)
WS (f): spectrum of brightness variations
VTF (f): visual property of space frequency
a and b: coefficients.

[Evaluation Criteria]

Marks in Table 3 respectively represent the following criteria:

A (vary excellent): zero or more to less than 0.1
B (excellent): 0.1 or more to less than 0.2
D (allowable to use): 0.2 or more to less than 0.3
E (unallowable to use): 0.3 or more (3) Carrier Adhesion Only a part of the carrier was transferred onto a sheet of paper even when carrier adhesion actually occurred, and thus a part of the carrier on the image bearing member was transferred onto a sheet of paper with a pressure-sensitive adhesive tape, and the respective developers were evaluated as to the carrier adhesion.

Specifically, image patterns of 2 dot lines (100 lpi) in the direction of secondary-scanning-line were formed and the direct current bias component of −400V was applied, and in this condition evaluations were conducted by visually counting the number of carriers (of area of 100 $cm^2$) adhered in between the lines of the 2 dot lines.

Marks of Table 3 respectively show the following evaluation criteria:

A: Very excellent
B: Excellent
C: No problems
D: Allowable to use
E: Poor (unallowable level)

(4) Background Smear after Running Output of 50,000 Sheets

Running output evaluations of 50,000 sheets of paper having a 6% letter image-area coverage proportion chart were conducted with supplying toner, which was used for the beginning stage of image output, and background smears were evaluated in the same criteria as described above in (1).

The evaluation results are shown on Table 3.

TABLE 3

| | Carrier | Background smear [rank] | Granularity [rank] | Carrier adhesion [rank] | Background smear after running output of 50,000 sheets [rank] |
|---|---|---|---|---|---|
| Ex. 1 | Product Ex. 1 | B | B | C | D |
| Ex. 2 | Product Ex. 2 | B | B | C | D |
| Comparative Ex. 1 | Product Ex. 3 | A | A | E | B |
| Comparative Ex. 2 | Product Ex. 4 | E | E | A | E |
| Comparative Ex. 3 | Product Ex. 5 | B | B | E | C |
| Comparative Ex. 4 | Product Ex. 6 | B | A | E | C |
| Comparative Ex. 5 | Product Ex. 7 | C | E | C | D |
| Comparative Ex. 6 | Product Ex. 8 | B | B | E | C |
| Ex. 3 | Product Ex. 9 | B | B | D | C |
| Ex. 4 | Product Ex. 10 | B | B | C | C |
| Ex. 5 | Product Ex. 11 | B | B | C | C |
| Ex. 6 | Product Ex. 12 | B | B | C | D |
| Ex. 7 | Product Ex. 13 | B | B | B | C |
| Ex. 8 | Product Ex. 14 | D | B | A | D |
| Ex. 9 | Product Ex. 15 | D | D | A | D |
| Ex. 10 | Product Ex. 16 | B | B | B | C |
| Ex. 11 | Product Ex. 17 | B | B | B | C |
| Ex. 12 | Product Ex. 18 | B | B | B | C |
| Ex. 13 | Product Ex. 19 | B | A | B | D |
| Ex. 14 | Product Ex. 20 | B | A | B | D |
| Ex. 15 | Product Ex. 21 | B | A | D | D |
| Ex. 16 | Product Ex. 22 | B | A | B | C |
| Ex. 17 | Product Ex. 23 | B | A | B | B |
| Ex. 18 | Product Ex. 24 | B | A | B | B |
| Ex. 19 | Product Ex. 25 | B | A | B | B |
| Ex. 20 | Product Ex. 26 | B | A | B | C |
| Ex. 21 | Product Ex. 27 | B | A | B | B |
| Ex. 22 | Product Ex. 28 | B | A | D | B |
| Ex. 23 | Product Ex. 29 | B | A | D | C |
| Ex. 24 | Product Ex. 30 | A | A | B | C |
| Ex. 25 | Product Ex. 31 | A | A | B | B |
| Ex. 26 | Product Ex. 32 | A | A | B | A |
| Ex. 27 | Product Ex. 33 | A | A | B | A |

The invention claimed is:

1. A carrier, comprising:

core material particles having magnetism; and a resin coating layer which covers surfaces of the core material particles, wherein a weight average particle diameter of the core material particles is from 22 μm to 32 μm, wherein a proportion of the weight average particle diameter of the core material particles relative to a number average particle diameter is from 1.00 to 1.20, wherein a content of the core material particles having a diameter of 20 μm or smaller is 7% by mass or less, relative to a total mass of the carrier, wherein a content of the core material particles having a diameter of 36 μm or smaller from 90% by mass to 100% by mass, relative to a total mass of the carrier, wherein a particle density of the core material particles relative to a true density of the core material particles is from 85% by mass to 100% by mass, wherein the resin coating layer comprises (i) a cross-linked product of a thermoplastic resin (i-a) and a guanamine resin (i-b), and (ii) hard particles, wherein the thermoplastic resin (i-a) is an acrylic resin, and wherein the hard particles (ii) comprises at least one selected from the group consisting of an Si oxide particle, a Ti oxide particle, and an Al oxide particle, wherein a particle density of the core material particles is from 4.5 g/cm$^3$ to 5.0 g/cm$^3$, wherein the particle density is a calculated volume of a particle density which includes internal closed cavities of a particle and excludes dents and cracks existing on the surface of the particle and opened spaces.

2. The carrier of claim 1, wherein a magnetization at a time when a magnetic field of a 1,000 Oersted is applied to the carrier is from 50 emu/g to 100 emu/g.

3. The carrier of claim 1, which is a Mn—Mg—Sr ferrite, a Mn ferrite, or a magnetite.

4. The carrier of claim 1, wherein a volume resistivity at a time when an electric field of 500 V/mm is applied is from $1\times10^{11}$ Ω·cm to $1\times10^{16}$ Ω·cm.

5. The carrier of claim 1, wherein a content of the hard particles in the resin coating layer is from 5% by mass to 70% by mass, relative to a total mass of the resin coating layer.

6. The carrier of claim 1, wherein the resin coating layer comprises an aminosilane coupling agent.

7. The carrier of claim 6, wherein the coupling agent comprises at least one selected from the group consisting of $H_2N(CH_2)_3Si(OCH_3)_3$, $H_2N(CH_2)_3Si(OC_2H_5)_3$, $H_2N(CH_2)_3Si(CH_3)_2(OC_2H_5)$, $H_2N(CH_2)_3Si(CH_3)(OC_2H_5)_2$, $H_2N(CH_2)_2NHCH_2Si(OCH_3)_3$, $H_2N(CH_2)_2NH(CH_2)_3Si(CH_3)(OCH_3)_2$, $H_2N(CH_2)_2NH(CH_2)_3Si(OCH_3)_3$, $(CH_3)_2N(CH_2)_3Si(CH_3)(OC_2H_5)_2$, and $(C_4H_9)_2N(CH_2)_3Si(OCH_3)_3$.

8. The carrier of claim 1, wherein the weight average particle diameter (Dw) of the core material particles is from 23 μm to 30 μm.

9. The carrier of claim 1, wherein the content of the core material particles having a diameter 20 μm or smaller is 5% by mass or less, relative to a total mass of the carrier.

10. The carrier of claim 1, wherein the content of the core material particles having a diameter 20 μm or smaller is 3% by mass or less, relative to a total mass of the carrier.

11. The carrier of claim 1, wherein the content of the core material particles having a diameter of 36 μm or smaller is 92% by mass or more, relative to a total mass of the carrier.

12. The carrier of claim 1, wherein the cross-linked product of the thermoplastic resin and the guanamine resin in the resin coating layer comprises the guanamine resin in a range of between 20% by mass and 50% by mass of the cross-linked product.

13. The carrier of claim 1, wherein a particle density of the core material particles is from 4.7 g/cm$^3$ to 5.0 g/cm$^3$.

14. The carrier of claim 1, wherein a content of the hard particles in the resin coating layer is from 5% by mass to 40% by mass, relative to a total mass of the resin coating layer.

15. The carrier of claim 1, wherein a particle density of the core material particles is from 4.5 g/cm$^3$ to 4.7 g/cm$^3$.

16. The carrier of claim 1, wherein a content of the hard particles in the resin coating layer is from 2% by mass to 40% by mass, relative to a total mass of the resin coating layer.

17. The carrier of claim 1, wherein a particle density of the core material particles is from 4.55 g/cm$^3$ to 4.87 g/cm$^3$.

18. A developer, comprising:

the carrier of claim 1; and a toner.

19. A method of forming an image, the method comprising:

forming an image with the developer of claim 18.

20. The method of claim 19, wherein the developer on a developer bearing member is used in a developing process for developing a latent electrostatic image formed on an image bearing member.

21. A carrier, comprising:

core material particles having magnetism; and a resin coating layer which covers surfaces of the core material particles, wherein a weight average particle diameter of core material particles is in a range of 22 μm to 32 μm, wherein a proportion of the weight average particle diameter of the core material particles relative to a number average particle diameter is from 1.00 to 1.20, wherein a content of the core material particles having a diameter of 20 μm or smaller is 7% by mass or less, relative to a total mass of the carrier, wherein a content of the core material particles having a diameter of 36 μm or smaller is in a range of 90% by mass to 100% by mass, relative to a total mass of the carrier, wherein a particle density of the core material particles relative to a true density of the core material particles is in a range of 85% by mass to 100% by mass, wherein the resin coating layer comprises (i) a cross-linked product of a thermoplastic resin (i-a) and a guanamine resin (i-b), and (ii) hard particles, wherein the thermoplastic resin (i-a) is an acrylic resin, and wherein the hard particles (ii) comprises at least one selected from the group consisting of an Si oxide particle, a Ti oxide particle, and an Al oxide particle.

22. The carrier of claim 21, wherein the content of the core material particles having a diameter 20 μm or smaller is 5% by mass or less relative to a total mass of the carrier.

23. The carrier of claim 21, wherein the content of the core material particles having a diameter 20 μm or smaller is 3% by mass or less relative to a total mass of the carrier.

24. The carrier of claim 21, wherein the content of the core material particles having a diameter of 36 μm or smaller is 92% by mass or more, relative to a total mass of the carrier.

25. The carrier of claim 21 wherein a content of the hard particles in the resin coating layer is in a range of 5% by mass to 70% by mass, relative to a total mass of the carrier.

26. The carrier of claim 21, wherein a particle density of the core material particles is from 4.55 g/cm$^3$ to 4.87 g/cm$^3$.

* * * * *